US005588169A

United States Patent [19]

Chuang

[11] Patent Number: 5,588,169

[45] Date of Patent: Dec. 31, 1996

[54] TOOL ASSEMBLY FOR BICYCLE

[76] Inventor: Louis Chuang, 11th Floor, - 1 No. 367, Gong Yi Road, Taichung, Taiwan

[21] Appl. No.: 427,437

[22] Filed: Apr. 24, 1995

[51] Int. Cl.[6] ..... B25F 1/02

[52] U.S. Cl. ..... 7/138; 7/165; 81/177.2

[58] Field of Search ..... 7/138, 139, 165, 7/167, 170; 59/7; 81/177.2, 437

[56] References Cited

U.S. PATENT DOCUMENTS 4,580,469 4/1986 Lordahl ..... 81/437
4,811,638 3/1989 Kertzscher ..... 81/177.2
5,303,439 4/1994 Seals ..... 7/138
5,313,860 5/1994 Liou ..... 81/437

*Primary Examiner*—James G. Smith
*Attorney, Agent, or Firm*—Charles E. Baxley, Esq.

[57] ABSTRACT

A tool assembly includes a body having one or more driving tool bits and one or more engaging holes formed in one end for driving fastening members, and having an engaging hole formed in the other end for engaging with a driving tool bit of a rod so as to extend the length of the driving arm of the body. A block is secured to the body and includes a middle portion having a slot for engaging with a chain and includes one end having a screw hole for engaging with a bolt. The bolt includes an extension for disengaging the pivot shafts from the chain so as to adjust the tightness of the chain.

7 Claims, 2 Drawing Sheets

TOOL ASSEMBLY FOR BICYCLE

BACKGROUND OF THE INVENTION

1. Field of the Invention

The present invention relates to a tool, and more particularly to a tool assembly for bicycles.

2. Description of the Prior Art

Typical bicycles comprise a rather compact bicycle frame which includes no rooms or spaces for storing repairing tools such that no special repairing tools are developed for bicycles. In order to repair bicycles, the users have to prepare a lot of screw drivers, wrenches. In addition, when the chain become loose, no tools are provided for disengaging the pivot shaft of the chain so as to tighten the chain.

The present invention has arisen to mitigate and/or obviate the afore-described disadvantages of the conventional tools for bicycles.

SUMMARY OF THE INVENTION

The primary objective of the present invention is to provide a tool assembly which includes a plurality of tool bits and engaging surfaces provided thereon for driving fastening members and which includes a device for disengaging pivot shafts of chains.

In accordance with one aspect of the invention, there is provided a tool assembly for a bicycle comprising a body including a first end having at least one first driving means provided thereon and including a second end having a first engaging hole formed therein, and a rod including a first end having a second driving means formed thereon for engaging with the first engaging hole of the body so as to extend a length of a driving arm of the body.

The first driving means includes at least one engaging opening, at least one second engaging hole and at least one driving tool bit formed in the first end of the body for driving fastening members.

The second end of the body further includes a block secured thereto, the block includes a middle portion having a slot formed therein :for engaging with chain means having pivot shafts therein, the block includes a first end having a screw hole formed therein for engaging with a bolt means the bolt means includes an extension for disengaging the pivot shafts from the chain means.

The block includes at least one driving tool bit extended therefrom and includes at least one second engaging hole formed therein for driving fastening members.

The first end of the rod further includes at least one driving tool bit extended therefrom, and the rod includes a second end having at least one driving tool bit extended therefrom for driving fastening members.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
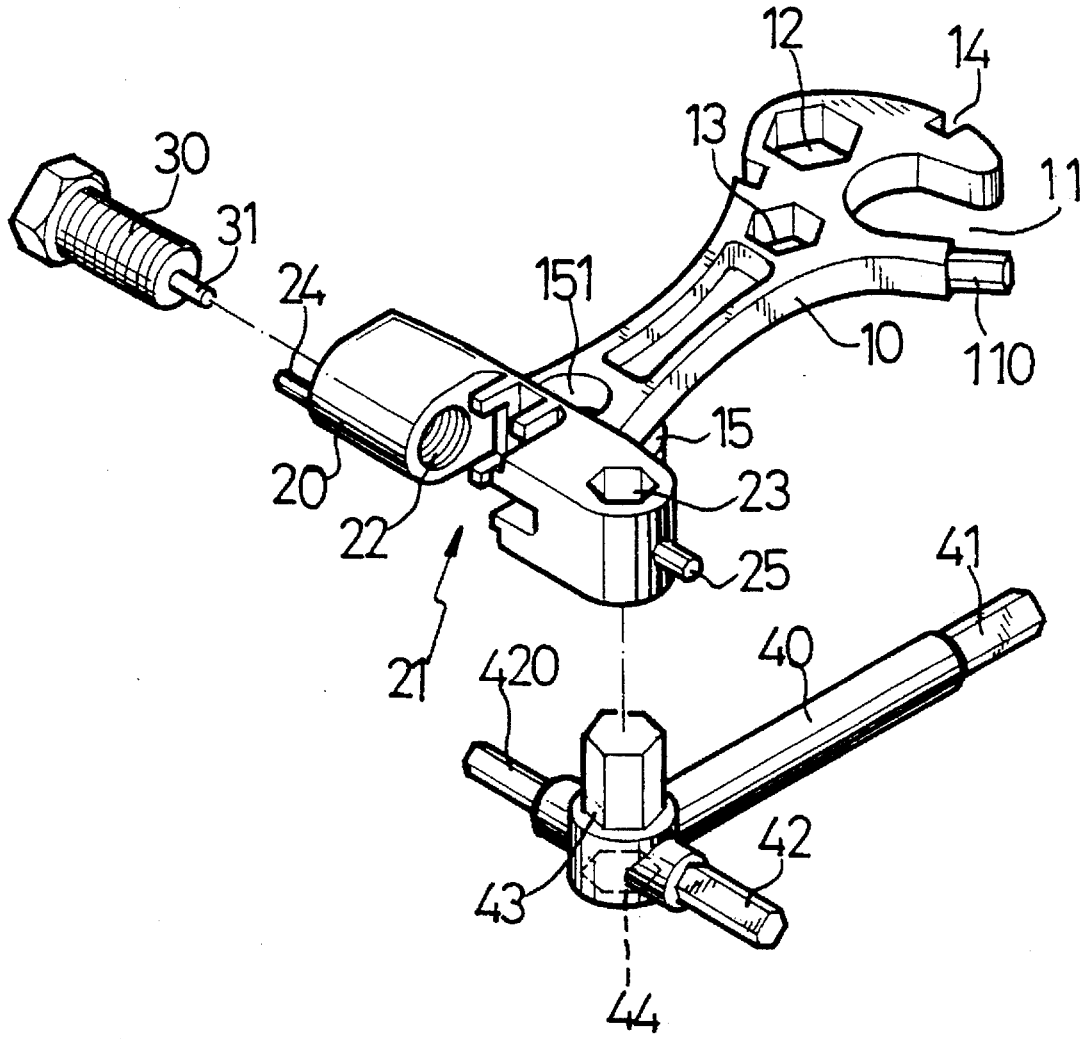
FIG. 1 is an exploded view of a tool assembly in accordance with the present invention.
Figure 2:
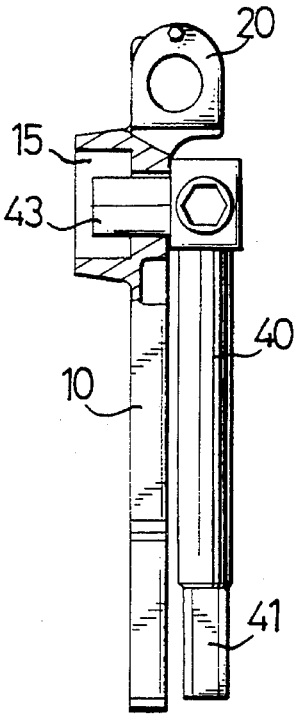
FIG. 2 is a plane view of the tool assembly, in which partial of the tool assembly is cut off.

Referring to the drawings, and initially to FIGS. 1 and 2, a tool assembly in accordance with the present invention comprises a body 10 including an wrench type engaging opening 11 and two notches 14 formed in the peripheral portion of one end portion thereof, including two engaging holes 12, 13 formed in the one end thereof, and including a driving tool bit 110 extended from the one end thereof, such as wrench driving bits or screw driver bits. The other end portion of the body 10 includes a socket 15 formed therein having an aperture 151 formed therethrough and includes a block 20 secured to the other end.

The block 20 includes a middle portion having a slot 21 formed therein for engaging with and for retaining the bicycle chain in place. One end of the block 20 includes a screw hole 22 formed therein for engaging with a bolt 30 which includes an extension 31 extended inward of the slot 21 for disengaging the pivot shafts of the chains and for forcing the pivot shafts into place so as to adjust the tightness of the chains. The block 20 includes two or more driving tool bits 24, 25 extended therefrom for driving fastening members. The other end of the block 20 includes a stepped engaging holes 23, 231 (FIG. 3) formed therein.

A rod 40 includes a stud or a driving tool bit 41 formed on one end thereof and includes another driving tool bit 43 formed in the other end and perpendicular to the rod 40. Two driving tool bits 42, 420 are extended laterally from the tool bit 43. An engaging hole 44 is formed in the driving tool bit 43 for engaging with other driving tool bits. The tool bit 43 of the rod 40 may be engaged in the aperture 151 of the socket 15 and the rod 40 may be engaged with and aligned with the body 10 so as to form a rather compact configuration which is excellent for storing and for transportation purposes.

Figure 3:
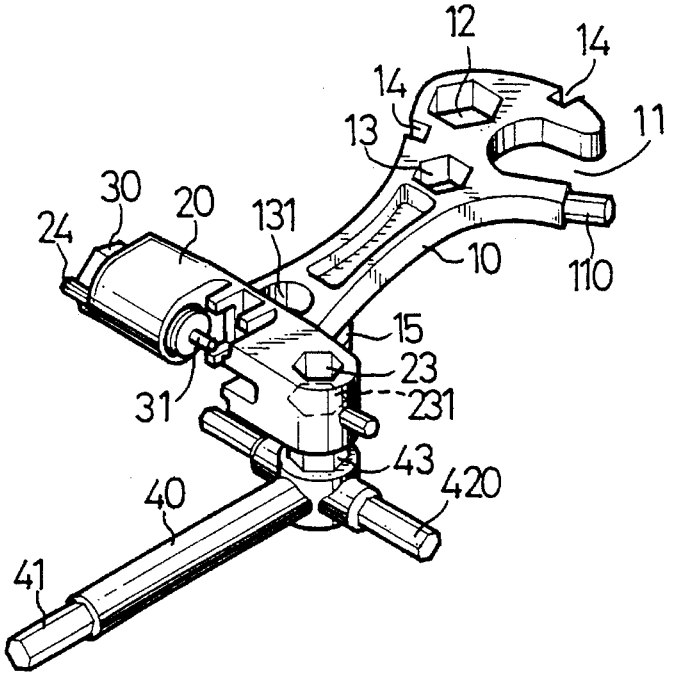
FIGS. 3 and 4 are perspective views illustrating the applications of the tool assembly.
Figure 4:
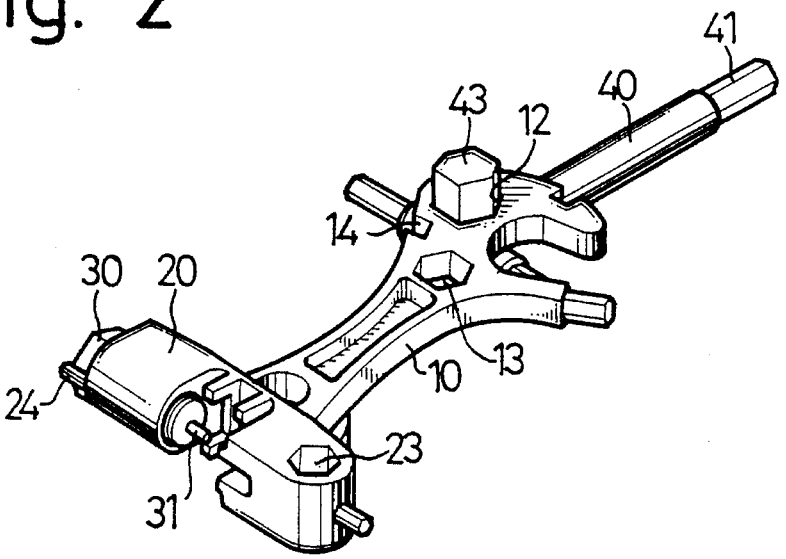

Referring next to FIGS. 3 and 4, the tool bit 43 may be engaged with either of the engaging holes 12, 13, 231 so as to extend the length of the driving arm of the body 10. The extension 31 of the bolt 30 may be forced toward the chain engaged in the slot 21 and may force the pivot shafts of the chain outward from the chain so as to change the length of the chain and so as to adjust the tightness of the chain. The driving tool bits 24, 25, 110, 42, 420, 41, 43 include different sizes and may be provided for driving fastening members. The engaging holes 12, 13, 11, 151, 23, 231, 44 may also be provided for engaging with and for driving fastening members.

Accordingly, the tool assembly for bicycles in accordance with the present invention includes a rather compact configuration having a number of driving tool bits and a number of engaging holes provided therein for driving fastening members. The tool assembly further includes a means for disengaging and for replacing pivot shafts of the chains in order to adjust the tightness of the chains.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool assembly for a bicycle comprising:

a body (10) including a first end and a second end, the first end having at least one engaging hole (12, 13) defined therein and at least one engaging opening (11, 14)

defined in a peripheral portion thereof, the second end having a socket (15) formed on a first side thereof and including a block (20) secured thereto, the block (20) extending in a direction traverse to a longitudinal direction of the body (10) and including a slot (21) defined in a middle portion thereof for receiving a chain means having pivot shafts therein, the block further comprising a first end having a screw hole (22) defined therein and extending along a longitudinal direction thereof for engaging with a bolt means (30), the bolt means (30) including an extension (31) for disengaging the pivot shafts from the chain means; and a rod (40) including a first end having a first driving tool bit (41) projecting longitudinally and outwardly therefrom and a second end having a second driving tool bit (43) projecting outwardly in a direction perpendicular to the longitudinal direction of the rod (40), the second driving tool bit (43) including a first end with two sides which is integral with the second end of the rod, and a third driving tool bit (42) and a fourth driving tool bit (420) respectively projecting laterally and outwardly from the two sides of the second driving tool bit in a direction perpendicular to the longitudinal direction of the rod and perpendicular to a longitudinal direction of the second driving bit.

2. The tool assembly as claimed in claim 1, wherein the first end of the body (10) further includes a fifth driving tool bit (110) formed on the peripheral portion thereof.

3. The tool assembly as claimed in claim 2, wherein the first end of the block (20) includes a sixth driving tool bit (24) formed on a periphery thereof.

4. The tool assembly as claimed in claim 3, wherein the block (20) includes a second end with a periphery, and a seventh driving tool bit (25) is formed on the periphery of the second end of the block.

5. The tool assembly as claimed in claim 4, wherein the second end of the block further includes a stepped engaging hole (23, 231) defined therein.

6. The tool assembly as claimed in claim 1, wherein the socket (15) includes an aperture (151) defined therein.

7. The tool assembly as claimed in claim 1, wherein the first end of the second driving tool bit (43) includes a second engaging hole (44) defined therein.

* * * * *